US005669517A

United States Patent [19]

Donaldson et al.

[11] Patent Number: 5,669,517

[45] Date of Patent: Sep. 23, 1997

[54] ARTICULATING BOOM INCORPORATING A LINKAGE COUNTERWEIGHT

[75] Inventors: James A. Donaldson, Puyallup; Matthew S. Fearon, Issaquah, both of Wash.

[73] Assignee: Genie Industries, Inc., Redmond, Wash.

[21] Appl. No.: 661,925

[22] Filed: Jun. 11, 1996

[51] Int. Cl.[6] ..... B66C 23/76

[52] U.S. Cl. ..... 212/196

[58] Field of Search ..... 414/673, 917; 212/195, 196, 197

[56] References Cited

U.S. PATENT DOCUMENTS

| | | | |
|---|---|---|---|
| Re. 31,400 | 10/1983 | Rallis et al. . | |
| 1,245,186 | 11/1917 | Brothers | 212/196 |
| 1,877,373 | 9/1932 | Cohen-Venezian . | |
| 1,973,136 | 9/1934 | Atkinson . | |
| 2,408,500 | 10/1946 | West . | |
| 2,627,560 | 2/1953 | Eitel . | |
| 3,470,981 | 10/1969 | Huxley . | |
| 3,883,105 | 5/1975 | Matsumoto | 414/917 |
| 3,924,753 | 12/1975 | Lamer et al. . | |
| 4,215,972 | 8/1980 | Yamasaki et al. | 212/196 |
| 4,567,990 | 2/1986 | Bellio . | |
| 4,666,364 | 5/1987 | Doege et al. | 414/917 |
| 5,203,837 | 4/1993 | Madic et al. | 212/196 |
| 5,348,172 | 9/1994 | Wilson . | |

FOREIGN PATENT DOCUMENTS

| | | | |
|---|---|---|---|
| 404800 | 8/1968 | Australia | 212/195 |

*Primary Examiner*—Thomas J. Brahan

*Attorney, Agent, or Firm*—Christensen O'Connor Johnson & Kindness PLLC

[57] ABSTRACT

A linkage mounted counterweight for offsetting a load at the free end of an articulated boom crane (20). The articulated boom crane (20) includes an articulated boom (23) that includes an elevate linkage (25) and a telescoping section (24) is disclosed. The elevate linkage (25) includes a lower section (42) and a mid section (44). The counterweight (60) is located on the lower section (42) near where the lower section (42) is hingedly attached to the base of the crane (20). As the articulated boom (23) is raised from a stowed position, the counterweight moves away from the tilting fulcrum (F) of the articulated boom crane (20) to assist in maintaining the stability of the crane.

14 Claims, 2 Drawing Sheets

ARTICULATING BOOM INCORPORATING A LINKAGE COUNTERWEIGHT

FILED OF THE INVENTION

This invention is directed to cranes, and more particularly is directed to counterweights for countering a load located at the free end of a boom crane.

BACKGROUND OF THE INVENTION

Many different types of cranes for positioning workers and material at various heights have been proposed and are presently in use. Cranes are used in many environments, such as telephone line work, construction, fruit picking, general maintenance work on buildings, and the like.

One particularly advantageous crane is an articulated boom crane. An articulated boom crane includes an articulated boom formed by a plurality of sections hinged to one another. The sections are supported by a base that usually includes wheels and a drive system for transporting the crane. The boom sections have a Z-shaped profile when the boom is in a partially extended position. The lower boom sections make up an "elevate linkage" and the upper boom section, which may telescope, extends from the elevate linkage to a personnel platform that supports the operator of the crane. Such an articulated boom crane is also known as a Z-boom crane, because of the boom's Z-shaped profile when in use.

As will be readily understood by those familiar with articulated boom cranes, when the personnel platform of an articulated boom crane is extended away from the base of the boom, a tilting force is applied by the boom sections to the base of the crane. In the past, the tilting force has usually been counteracted by a static force, namely a weight, called counterweights, located at the base of the crane. A large base counterweight is contrary to a manufacturer's desire to reduce the overall weight of the machine for ease of transportation.

To offset the tilting force while maintaining the lowest overall weight of an articulated boom crane, manufacturers often add counterweights to an outer portion of the base of the crane, opposite the personnel platform. The addition of weight to this particular side of the base improves stability of the crane when the personnel platform is in an extended position. Unfortunately, the offset balance weight added to the base may cause leaning or listing to one side when the boom sections are lowered. This phenomenon occurs because as the personnel platform is lowered to a stowed position, the need for the counterweight to offset the tilt force produced by a loaded personnel platform decreases. As a result, the use of a static counterweight requires a location compromise that best meets the need an articulated boom crane to be stable in all configurations, while minimizing any list created by the weight added to the crane.

Another method of counteracting the tilting force applied to the base of an articulated boom crane by a loaded personnel platform is to enlarge the base footprint of the crane, such as by widening the lateral distance between the wheels that support the base or by increasing the distance between the wheel axes. Enlarging the footprint of the base in this manner is often undesirable because the boom may need to maneuver in narrow aisles or tight work spaces, or may need to pass through tight passageways such as double doorways.

Therefore, there is a need for an articulated boom crane that decreases the amount of weight added to the base of the crane to counteract the tilting force applied to the base of the crane by an extended personnel platform. The footprint of such a crane needs to be small enough to allow the crane to maneuver through narrow passageways and operate in tight workspaces. Preferably, such an articulated boom crane should be stable in all configurations, regardless of the distance that the articulated boom is extended.

SUMMARY OF THE INVENTION

In accordance with the present invention an improved articulated boom crane that addresses the problems set forth above is provided. More specifically, in accordance with this invention, an articulated boom crane having a counterweight fastened to the lower section of the elevate linkage of the boom is provided. Placing the counterweight in this location causes the counterweight to move farther from the tipping fulcrum of the base of the articulating boom crane as the elevate linkage of the boom is raised. By locating the counterweight such that the horizontal distance between the tipping fulcrum and the weight increases as the load is raised, the crane's center of gravity is shifted away from the tipping fulcrum to a more favorable stability position for all configurations of the articulated boom crane.

In accordance with other aspects of this invention, an articulated boom crane having a base and three boom sections hingedly connected to one another is provided. Two of the sections form an elevate linkage and the third section, sometimes called the primary boom section, supports a load, such as a personnel platform. The lower boom section of the elevate linkage is hingedly attached to the base. A counterweight is mounted on the lower boom section of the elevate linkage.

In accordance with other aspects of this invention, the lower boom section includes a lower compression arm and a lower secondary arm. The lower compression arm and the lower secondary arm lie generally parallel to one another. The lower compression arm lies above the lower secondary arm and the counterweight is located on the lower compression arm.

In accordance with further aspects of this invention, for maximum counterweight efficiency, the counterweight is located on the lower end of the lower arm. Thus, the counterweight is located adjacent to the side of the base furthest away from the load receiving end of the third (primary) section of the boom.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1:
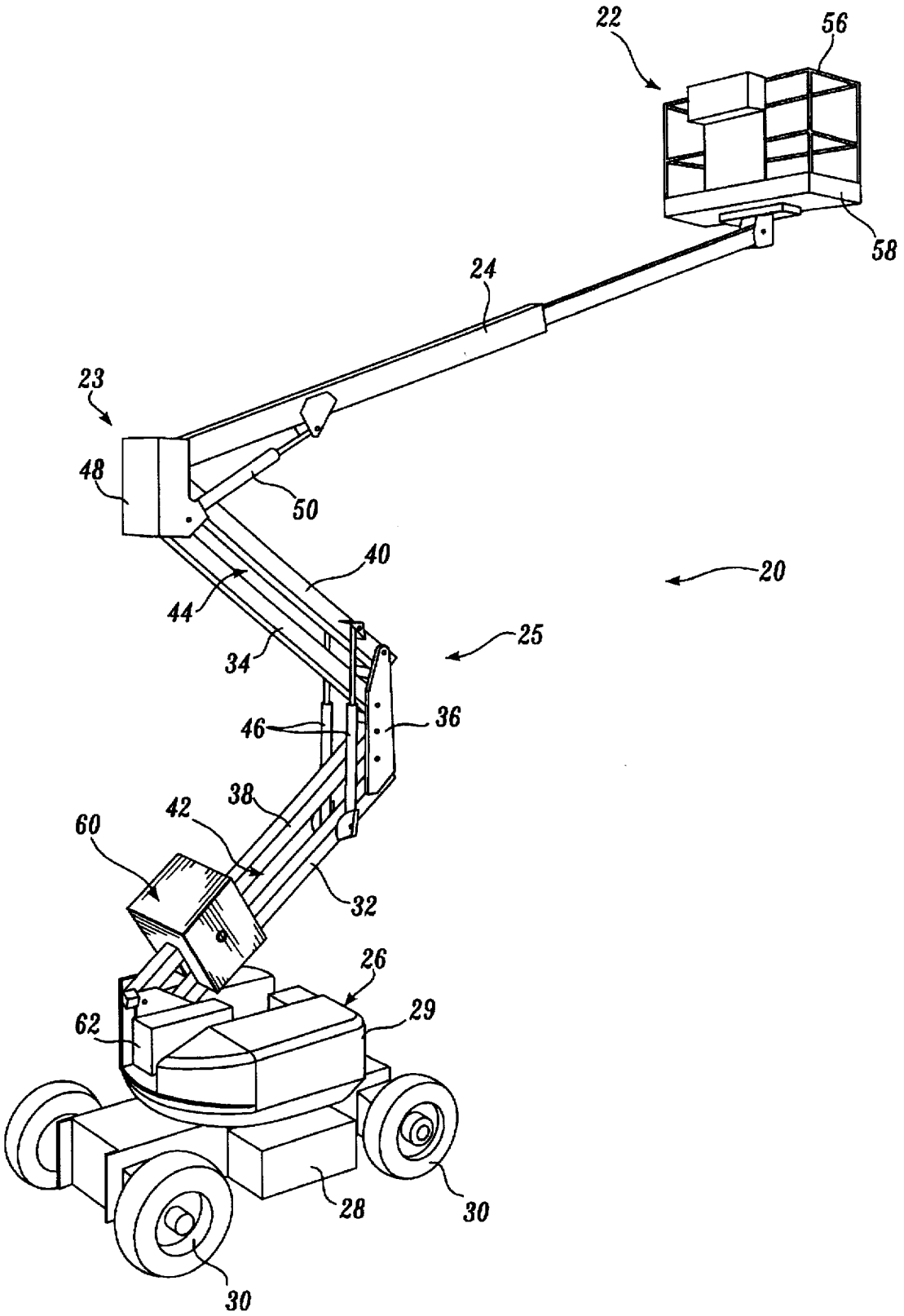
FIG. 1 discloses a perspective view of an articulated boom crane incorporating the present invention, with the boom in an extended position.
Figure 2:
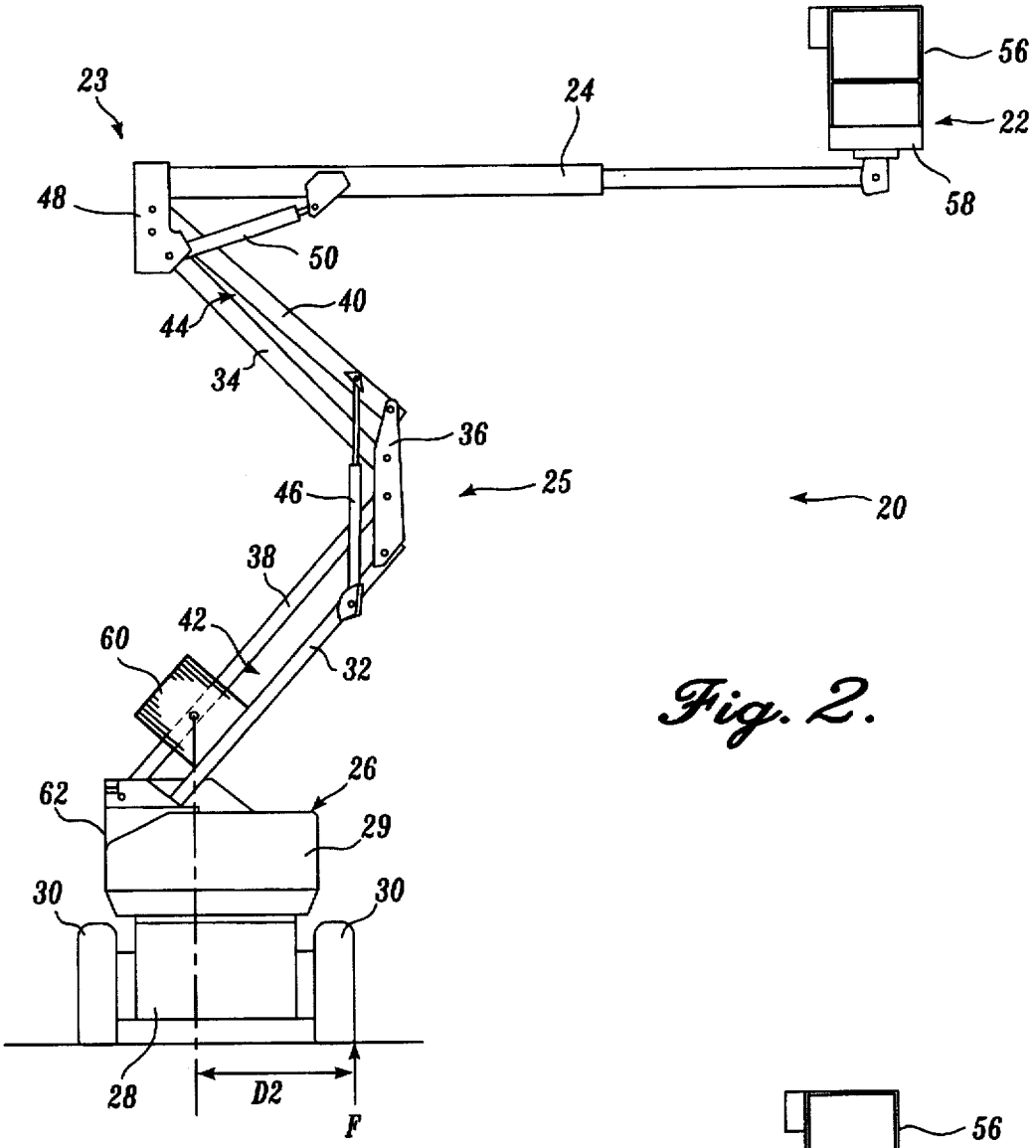
FIG. 2 is a side view of the articulated boom crane of FIG. 1, with the personnel platform in a raised position.
Figure 3:
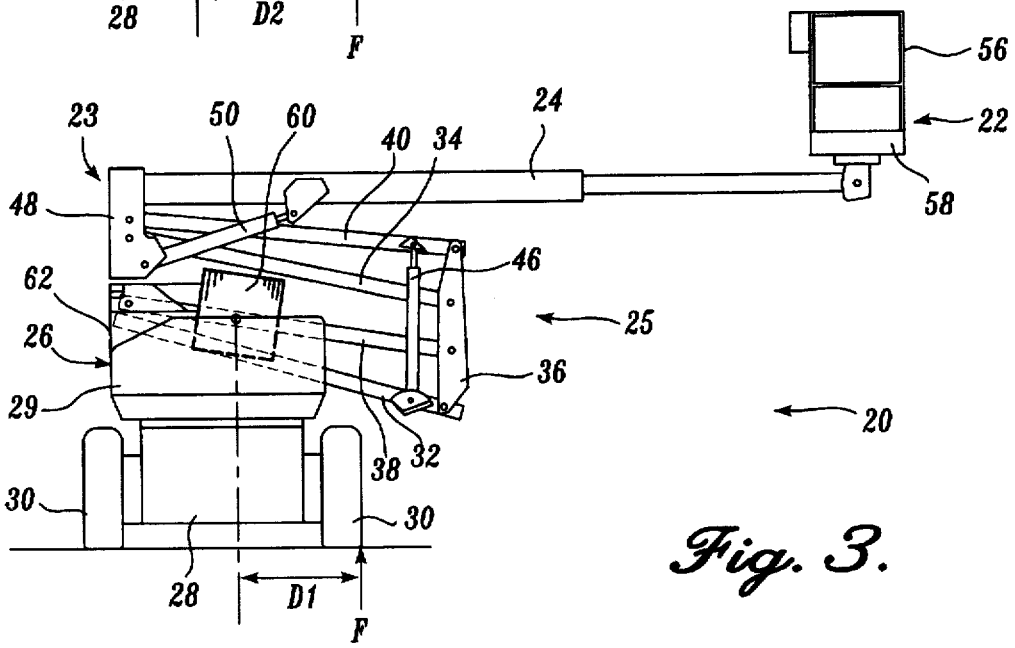
FIG. 3 is a side view of the articulated boom crane of FIG. 1, with the personnel platform in the stowed position.

Referring now to the drawing, in which like numerals represent like parts throughout the several views, FIG. 1 is a perspective view of an articulated boom crane 20 incorporating the present invention. The articulated boom crane 20 includes a personnel platform 22 attached to the load-receiving end of a three section Z-shaped, articulated boom 23. The upper section 24 of articulated boom 23 is attached to the personnel platform 22 and telescopes. The mid and lower sections 44 and 42 form an elevate linkage 25. The elevate linkage 25 extends from a turntable 26 that is mounted on a drive chassis 28. The turntable 26 and the drive chassis 28 form the base of the articulating boom crane 20 shown. Briefly described, the articulating boom crane 20 is designed such that the articulated boom 23 can extend upward, as shown in FIGS. 1 and 2, or can be lowered into a stowed position, as shown in FIG. 3. The drive chassis 28 can be operated like a vehicle to move the articulated boom crane 20 to a desired location. As is known in the art, the drive speed of the drive chassis is reduced when the articulated boom 23 is raised from the stowed position.

The turntable 26 is rotatably mounted on the drive chassis 28 such that the primary boom 24 can extend in any direction from the drive chassis. The turntable 26 includes a hardened outer shell 29 in which is mounted the engine and fuel tanks of the drive chassis 28 (not shown, but known in the art), as well as hydraulic and other equipment (not shown, but known in the art), needed to operate the articulating boom 20. The drive chassis 28 includes four wheels 30, which define the outer edges of the base of the articulated boom crane 20.

The lower section 42 of the elevate linkage 25 includes a lower secondary arm 32, which extends from the turntable 26 to an upper secondary arm 34. As described more fully below, upper secondary arm 34 forms part of the upper section 44 of the elevate linkage 25. The lower secondary arm 32 and the upper secondary arm 34 are connected by a lower mid-pivot assembly 36.

As can best be seen in FIG. 2, a lower compression arm 38 extends parallel to, and lies just above, the lower secondary arm 32. Similarly, an upper compression arm 40 extends parallel to, and lies just above, the upper secondary arm 34. The lower compression arm 38 and the lower secondary arm 32 collectively form the lower section 42 of the elevate linkage 25 and the upper compression arm 40 and the upper secondary arm 34 form the mid section 44 of the elevate linkage 25. The lower mid-pivot assembly 36 is hingedly affixed to adjacent ends of the lower secondary arm 32, the upper secondary arm 34, the upper compression arm 40 and lower compression arm 38 in a conventional and well known manner. The other ends of the lower secondary arm 32 and the lower compression arm are hingedly affixed to the turntable 26, also in a conventional and well known manner.

Secondary lift hydraulic actuators 46 are attached to and extend between the upper secondary arm 34 of the upper section 44 and the lower secondary arm 32 of the lower section 42 of the elevate linkage 25. It is to be understood that either or both of the mid and lower sections 44, 42 of the elevate linkage 25 could be formed of single, or include additional, arms as is required by the force to be applied to the articulated boom 23 during use. For example, the lower secondary arm 32, the lower compression arm 38, the upper secondary arm 34, and the upper compression arm 40 could each be formed by a pair of elements extending horizontally parallel to one another.

The elevate linkage 25 extends from the turntable 26 to the lower end of an upper mid-pivot assembly 48. More specifically, the upper ends of the upper secondary arm 34 and the upper compression arm 40 are hingedly affixed to the upper mid-pivot assembly 48. One end of the telescoping section 24 of the articulated boom 23 is hingedly attached to the upper end of the upper mid-pivot assembly 48. A primary lift hydraulic actuator 50 extends between the lower end of the upper mid-pivot assembly 48 and the telescoping section of the articulated boom 23. The personnel platform 22 is attached to the distal, load-receiving end of the telescoping section 24, which is sometimes called the primary boom section.

The personnel platform 22 may include any number of features needed to meet the requirements of a given application. For example, the personnel platform 22 may have room for one or more workers, and one or more toolboxes. In addition, the personnel platform 22 may include a 180° platform rotation mechanism, which allows the platform to be aligned in any desired direction (not shown), or the platform may include attachments such as a jib boom (not shown), which offers further flexibility of movement of the platform. For ease of illustration, the personnel platform 22 shown in the drawing is a simple construction made to hold two people. The platform includes a cage 56 and a standing base 58. Controls (not shown) are typically provided at the cage 56 for operating the articulating boom crane 20.

The elements of the articulated boom crane 20 described thus far are standard in the industry, and their assembly and operation are well known in the art. The present invention comprises an improvement for the articulated boom crane of the type shown in drawings and for other cranes that include a boom that extends outward from a base. The improvement comprises positioning a counterweight 60 on the lower section 42 of the elevate linkage 25. In the embodiment shown, the counterweight 60 is located on the lower compression arm 38, proximal to where the lower section 42 is hingedly affixed to the turntable 26. The counterweight 60 may be attached in any conventional manner, or may be formed integrally with the lower compression arm 38.

The operation of the articulating boom crane 20 will be readily understood by those skilled in the art and others from the foregoing description. The position of the personnel platform 22 is raised or lowered by using a number of controls (not shown, but known in the art) mounted in the cage 56. Supplying hydraulic fluid to the cylinder of the secondary lift hydraulic actuator on the side of the actuator piston that causes the shaft of the actuator to extend causes the elevate linkage 25 to extend upward and the personnel platform 22 is raised. Supplying hydraulic fluid to the primary lift hydraulic actuator 50 on the side of the actuator piston that causes the cylinder of the shaft of the actuator to extend also raises the personnel platform 22. A further hydraulic actuator (not shown) controls the extension of the telescoping section 24 of the articulated boom 23. Supplying hydraulic fluid to the opposite sides of the actuator piston while withdrawing hydraulic fluid from the pressurized side of the cylinders of the actuators causes a shortening of the telescoping section and a lowering of the personnel platform, all in a conventional manner.

The control system for an articulating boom crane is preferably programmed so that the primary and secondary actuators are operated simultaneously to raise the personnel platform to the desired height and adjust the amount the personnel platform extends outwardly away from the turntable 26. A skilled operator can manipulate the cage controls such that the personnel platform 22 may be extended to any desired location within range of the crane. In addition, the controls in the cage 56 can be used to operate the chassis drive system to move the crane to a desired location. Interlocks are usually provided that reduce drive speed when the personnel platform 22 is in the elevated position shown in FIG. 2.

As will be readily understood by those skilled in this art, there are numerous articulating boom positions, such as the position shown in FIG. 2, where the personnel platform 22 is offset from the drive chassis 28 by an amount sufficient to apply a tilt force on the turntable 26 and the drive chassis 28. The tilt fulcrum of the articulated boom crane 20 depicted in FIGS. 1–3 is defined by the wheels 30. By way of example only, FIGS. 2 and 3 show the articulated boom 23 extending orthogonally outwardly from one side of the base of the articulated boom crane. In this orientation, the outer bottom corners of the wheels 30 located on the side of the base underlying the outwardly extending articulated boom 23 defines the fulcrum point, which is designated by the character "F" in FIGS. 2 and 3. It is to be understood that the location of the tilting fulcrum F will change as the Z-boom 23 is rotated about the base. To prevent tilting or tipping of the articulated boom crane 20, an opposite force must be created to counteract the force applied by the articulated boom 23 and the weight in the personnel platform 22 to the base of the articulated boom crane 23. In the past, the opposite force has been created by a large base counterweight. In accordance with the invention the size of the base counterweight for a predetermined articulated boom 23 and weighted personnel platform 22 is reduced by the counterweight 60 mounted on the lower compression arm 38 of the lower section 42 of the elevate linkage 25.

The counteracting force created by the counterweight 60, which is on the side of the tipping fulcrum F opposite the lead applied by the personnel platform 22, increases as the lower section of the elevate linkage rises. More specifically, as the elevate linkage rises, the counterweight 60 is moved further away from the tilting fulcrum F. The further the counterweight 60 is offset from the tilting fulcrum F, the greater is the counterweight's moment arm, and the more effective the counterweight is in offsetting the tilting force created by the articulated boom 23 and the weighted personnel platform.

Locating the counterweight 60 on the elevate linkage in the manner illustrated in the drawings and described above is a more efficient way of counterbalancing the articulating boom crane 20 than adding an equal amount of weight to the base of the crane. As noted above and as can be seen in FIGS. 2 and 3, the location of the counterweight 60 on the lower section 42 of the elevate linkage 25 causes the counterweight to move outward and away from the tipping fulcrum F as the elevate linkage 25 is raised. As can be seen in FIGS. 2 and 3, the horizontal distance D of the center of gravity of the counterweight 60 from the tipping fulcrum F is less at the stowed position of FIG. 3 (D1) than in the raised position of FIG. 2 (D2), where the counterbalancing effect of the counterweight is needed more. Effectiveness of the counterweight 60 is maximized by placing the counterweight on the lower arm 42 nearest the side 62 of the turntable 26 furthest away from the personnel platform 22. By locating the counterweight 60 such that the horizontal distance D of the center of gravity of the counterweight 60 from the fulcrum F increases as the personnel platform 22 is raised, the center of gravity of the articulating boom crane 20 is shifted away from the tipping fulcrum F as the elevate linkage 25, and the personnel platform 22 are raised. As a result, the articulating boom crane 20 is more stable over the entire range of movement of the articulated boom 23. The strategic placement of the counterweight 60 reduces the amount of counterweighting required by a specific articulating boom crane designed, resulting in lower overall gross vehicle weight.

The size and location of the counterweight 60 should be chosen to properly offset the uneven weight distribution contemplated by raising the personnel cage 22. Although a particular amount of weight may be optimal, it is to be understood that any weight added to the lower section 42 of the elevated linkage 25 that moves away from the tilting fulcrum as the elevate linkage is raised will accomplish the function of the invention.

While the presumably preferred embodiment of the invention has been illustrated and described, it will be appreciated that various changes can be made therein without departing from the spirit and scope of the invention. For example, other load receiving mechanisms could replace the personnel platform at the load-receiving end of the upper or primary section 24 by the articulate boom 25. In addition, the counterweight 60 could be placed on the lower secondary arm 32 instead of the lower compression arm 38. In an embodiment which utilizes pairs of members for the Z-boom 23 (described earlier, but not shown), the counterweight 60 could extend across parallel members of the lower compression arm 38.

The embodiments of the invention in which an exclusive property or privilege is claimed are defined as follows:

1. An articulated boom crane comprising:

a base;

an articulated boom for supporting a load at an end comprising:

a lower section having first and second ends, the first end of the lower section being hingedly attached to the base;

a central section having first and second ends, the first end of said central section being hingedly attached to the second end of the lower section;

an upper section having first and second ends, the first end of the upper section being hingedly attached to the second end of the central section, the second end of the upper section forming the load-supporting end of the articulated boom; and a counterweight mounted on the lower section of the articulated boom between the first end of the lower section and the second end of the lower section.

2. The articulated boom crane of claim 1, wherein:

the lower section includes a lower compression arm and a lower secondary arm;

the lower compression arm and the lower secondary arm extend generally parallel to one another;

the lower compression arm lies above the lower secondary arm; and the counterweight is located on the lower compression arm.

3. The articulated boom crane of claim 1, wherein the counterweight is located on the lower section of the elevate linkage near where the lower section is hingedly attached to the base.

4. The articulated boom crane of claim 3 wherein:

the lower section includes a lower compression arm and a lower secondary arm;

the lower compression arm and the lower secondary arm extend generally parallel to one another;

the lower compression arm lies above the lower secondary arm; and the counterweight is located on the lower compression arm.

5. The articulated boom crane of claim 1, wherein the base includes a rotatable turntable and the lower section of the elevate linkage is hingedly attached to the rotatable turntable.

6. The articulated boom crane of claim 5, wherein:

the lower section includes a lower compression arm and a lower secondary arm;

the lower compression arm and the lower secondary arm extend generally parallel to one another;

the lower compression arm lies above the lower secondary arm; and the counterweight is located on the lower compression arm.

7. The articulated boom crane of claim 5, wherein the counterweight is located on the lower section of the elevate linkage near where the lower section is hingedly attached to the base.

8. The articulated boom crane of claim 7 wherein:

the lower section includes a lower compression arm and a lower secondary arm;

the lower compression arm and the lower secondary arm extend generally parallel to one another;

the lower compression arm lies above the lower secondary arm; and the counterweight is located on the lower compression arm.

9. The articulated boom crane of claim 5, wherein the base further includes a rolling chassis and wheels and the rotatable turntable is mounted on the rolling chassis.

10. The articulated boom crane of claim 9, wherein:

the lower section includes a lower compression arm and a lower secondary arm;

the lower compression arm and the lower secondary arm extend generally parallel to one another;

the lower compression arm lies above the lower secondary arm; and the counterweight is located on the lower compression arm.

11. The articulated boom crane of claim 9, wherein the counterweight is located on the lower section of the elevate linkage near where the lower section is hingedly attached to the base.

12. The articulated boom crane of claim 11 wherein:

the lower section includes a lower compression arm and a lower secondary arm;

the lower compression arm and the lower secondary arm extend generally parallel to one another;

the lower compression arm lies above the lower secondary arm; and the counterweight is located on the lower compression arm.

13. In a crane comprising a base defining a tipping fulcrum and a boom defining first and load-receiving ends, the first end hingedly attached to the base, the boom configured so that the load-receiving end of the boom may be raised and lowered from the base; the improvement comprising a counterweight mounted on the boom such that the counterweight remains between (1) the tipping fulcrum and the first end of said boom and (2) the first and load receiving ends of the boom when the load-receiving end of the boom is raised or lowered from the base.

14. The improvement claimed in claim 13, wherein said counterweight is located on said boom near where said boom is hingedly attached to said base.

* * * * *